US005907155A

United States Patent [19]

Skinner

[11] Patent Number: 5,907,155

[45] Date of Patent: May 25, 1999

[54] CONSTANT DC OFFSET CORONODE VOLTAGE TRACKING CIRCUIT

[75] Inventor: Gary W. Skinner, Rochester, N.Y.

[73] Assignee: Xerox Corporation, Stamford, Conn.

[21] Appl. No.: 09/004,761

[22] Filed: Jan. 8, 1998

[51] Int. Cl.[6] ..... H01T 14/24

[52] U.S. Cl. ..... 250/326; 250/324; 250/325

[58] Field of Search ..... 250/326, 325, 250/324; 399/89, 171, 170; 361/225, 219, 221

[56] References Cited

U.S. PATENT DOCUMENTS

| | | | |
|---|---|---|---|
| 3,909,614 | 9/1975 | Marshall | 250/324 |
| 4,638,397 | 1/1987 | Foley | 361/212 |
| 5,324,942 | 6/1994 | Mishra et al. | 250/326 |
| 5,839,024 | 11/1998 | May et al. | 250/325 |

*Primary Examiner*—Kiet T. Nguyen

[57] ABSTRACT

An apparatus for maintaining a substantially consistent current to voltage relationship in a corona charging device having an electrode energized by an AC voltage biased by a first DC offset voltage which is modified by a second DC voltage, and a control surface energized by a third DC voltage which is also varied by the second DC voltage. The apparatus includes a system for monitoring a portion of the AC voltage, and for superimposing the first DC voltage on the monitored voltage to generate a control voltage having an AC component and a DC component, and for further superimposing the second DC voltage on the control voltage to vary the control voltage in response to changes in the second DC voltage. The control voltage is then applied to the electrode of the corona charging device. The apparatus provides a constant DC offset coronode voltage tracking circuit that maintains a substantially consistent current to voltage relationship in a scorotron-type corona charging device.

16 Claims, 4 Drawing Sheets

CONSTANT DC OFFSET CORONODE VOLTAGE TRACKING CIRCUIT

This invention relates to charging devices. More particularly, the present invention concerns maintaining a substantially consistent current to voltage relationship in a corona charging device, having an electrode which is driven by an AC voltage and a control surface which is driven by a plurality of DC voltages over the operating range of the device.

In a typical electrophotographic process, a portion of a photoconductive member is charged by a corona generating device to a substantially uniform potential to sensitize the surface thereof. The charged portion is then exposed to a light pattern of an original image to selectively discharge the surface in accordance with the light pattern. The resulting pattern of charged and discharged areas on the photoconductive member forms an electrostatic charge pattern known as a latent image. The latent image is then developed by contacting it with a dry or liquid developer material made up of carrier and toner. The toner is attracted to the image areas and held thereon by the electrostatic charge on the surface of the photoconductive member. Thus, a toner image is produced in conformity with a light pattern. The toner image is transferred to a copy media, and the image affixed thereto to form a permanent record of the image to be reproduced. Subsequent to development, excess toner left on the photoconductive member is cleaned from its surface. The process is useful for light lens copying from an original document or for printing copies of digitized originals with a raster output scanner (ROS), where a charged surface may be imagewise discharged in a variety of ways.

The foregoing discussion generally describes a typical or single color process. The approach utilized for multicolor electrophotographic printing is substantially the same. However, instead of forming a single latent image on the photoconductive member, multiple latent images corresponding to different color separations are sequentially recorded on the photoconductive member. Each single color latent image is then developed with toner complimentary thereto. This process is repeated for each of the differently colored images with a respective toner of a complimentary color. Thereafter, each single color toner image is transferred to the copy media in superimposed registration with the prior toner image, creating a multi-layered toner image. This multi-layered toner image is permanently affixed to the copy media in a conventional manner to form a finished color copy.

Various types of charging devices have been used to charge or precharge photoconductive insulating layers. In commercial use, for example, are various types of corona generating devices to which a high voltage of 5,000 to 8,000 volts may be applied to the corotron device thereby producing a corona spray that imparts electrostatic charge to the surface of the photoreceptor. One particular device takes the form of a single corona wire strung between insulating end blocks mounted on either end of a channel or shield.

A corona charging device is described in U.S. Pat. No. 4,086,650 to Davis et al., commonly referred to in the art as a dicorotron wherein the corona discharge electrode is coated with a relatively thick dielectric material such as glass so as to substantially prevent the flow of DC current therethrough. The delivery of charge to the photoconductive surface is accomplished by means of a displacement current or capacitive coupling through dielectric material. The flow of charge to the surface to be charged is regulated by means of a DC bias applied to the corona bias shield. In operation, an AC potential of from about 5,000 to 7,000 volts at a frequency of about 4 KHz produces a true corona current, an ion current of 1 to 2 milliamps. This device has the advantage of providing a uniform negative charge to the photoreceptor. In addition, it is a relatively low maintenance charging device in that it is the least sensitive of the charging devices to contamination by dirt and therefore does not have to be repeatedly cleaned.

In addition to the desirability to negatively charge one type of photoreceptor it often is desired to provide a negative precharge to another type photoreceptor such as selenium alloy prior to its being actually positively charged. A negative precharging is used to neutralize the positive charge remaining on the photoreceptor after transfer of the developed toner image to the copy sheet and cleaning to prepare the photoreceptor for the next copying cycle. Typically, in such a precharge corotron an AC potential of between 4,500 and 6,000 volts rms at 400 to 600 Hz may be applied. A typical conventional corona discharge device of this type is shown generally in U.S. Pat. No. 2,836,725 in which a conductive corona electrode in the form of an elongated wire is connected to a corona generating AC voltage.

Another device, which is frequently used to provide more uniform charging and to prevent overcharging, is a scorotron which can be comprised of one, or more corona generating wires or pin arrays with a conductive control grid or screen of parallel wires or apertures in a plate positioned between the corona generating wires and the photoconductor. A potential is applied to the control grid of the same polarity as the corona potential but with a much lower voltage, usually several hundred volts, which suppresses the electric field between the charge plate and the corona generating wires and markedly reduces the ion current flow to the photoreceptor. This concept was first disclosed in U.S. Pat. No. 2,777,957 to L. E. Walkup.

The following references may be relevant to the present invention:

U.S. Pat. No. 5,324,942

Patentee: Mishra

Issued: Jun. 28, 1994

U.S. Pat. No. 4,638,397

Patentee: Foley

Issued: Jan. 20, 1987

U.S. Pat. No. 3,909,614

Patentee: Marshall

Issued: Sep. 30, 1975

U.S. Pat. No. 5,324,942 discloses an apparatus for tuning or altering the charge potential limiting effect that a scorotron grid has upon an adjacent charge receiving surface. The scorotron charging apparatus utilizes corona producing means, spaced above the charge retentive surface, for emitting corona ions in response to a high voltage potential applied thereto, and a flexible grid, suspended between said corona producing means and the charge retentive surface in a nonplanar fashion, such that the spacing between said grid and the charge retentive surface is variable along at least one region of said grid.

U.S. Pat. No. 4,638,397 discloses a scorotron and control therefor for charging and/or discharging a charge retentive surface such as a photoreceptor of the type utilized in the process of xerographic printing. The control connects the wire grid of the scorotron to ground via a plurality of zener diodes and a variable resistor. The voltage across the variable resistor is low compared to the total circuit voltage so that variations in the grid current result in small variations in grid voltage. The control provides for compensation for out of tolerance zener diodes as well as photoreceptor aging manufacturing tolerances and temperature elevation. When the variable resistor is a light dependent resistor a light emitting diode contained in a bridge network also containing a thermistor provides for automatic compensation due to elevation in photoreceptor temperature when such temperature is sensed by the thermistor.

U.S. Pat. No. 3,909,614 discloses a scorotron for uniformly charging an electrostatographic copying photoconductive surface having a coronode wire, a conductive metal shield and a screen grid. The coronode wire is supplied through a stabilizing resistor from an electrical inverter. The screen and the shield are connected together and commonly connected to ground through two series of connected resistors. From a connection point between the two resistors a feed-back loop is provided to supply feed-back signals to a regulator connected at the input of the inverter, which feed-back signals are indicative of the sum of the screen and shield currents from the coronode wire corona emission, but insensitive to proportional changes between the screen current and the shield current.

In accordance with one aspect of the present invention, there is provided a method for maintaining a substantially consistent current to voltage relationship in a corona charging device having an electrode energized by an AC voltage having a first DC voltage component and a second DC voltage component, and a control surface energized by a third DC voltage component which is varied by the second DC voltage component. The method comprises the steps of: monitoring a portion of the AC voltage, superimposing the first DC voltage component on the voltage monitored by the monitoring step to generate a control voltage having an AC component and a DC component, superimposing the second DC voltage component on the control voltage produced by the superimposing of the first DC voltage step to vary the control voltage in response to changes in the second DC voltage component, and supplying the control voltage produced in the superimposing of the second DC voltage step to the electrode of the corona charging device.

Pursuant to another aspect of the present invention, there is provided an apparatus for maintaining a substantially consistent current to voltage relationship in a corona charging device having an electrode energized by an AC voltage biased by a first and second DC voltage, and a control surface energized by a third DC voltage which is varied by the second DC voltage. The apparatus comprises a means for monitoring a portion of the AC voltage. A first means for superimposing the first DC voltage on the monitored voltage generates a control voltage having an AC component and a DC component. A second means for superimposing the second DC voltage on the control voltage varies the control voltage in response to changes in the second DC voltage. Means are supplying the control voltage to the electrode of the corona charging device.

Pursuant to yet another aspect of the present invention, there is provided a summing circuit for maintaining a substantially consistent current to voltage relationship in a corona charging device having an electrode energized by an AC voltage biased by a first and second DC voltage, and a control surface energized by a third DC voltage which is varied by the second DC voltage. The summing circuit comprises a resistive element for monitoring a portion of the AC voltage. A first resistive element for superimposing the first DC voltage on the monitored voltage generates a control voltage having an AC component and a DC component. A second resistive element for superimposing the second DC voltage on the control voltage varies the control voltage in response to changes in the second DC voltage. A conductor supplies the control voltage to the electrode of the corona charging device.

Pursuant to still another aspect of the present invention, there is provided a summing amplifier for maintaining a substantially consistent current to voltage relationship in a corona charging device having an electrode energized by an AC voltage having a reference DC offset voltage and a variable DC offset voltage, and a control surface energized by a second reference DC voltage varied by the variable DC offset voltage, comprising: a resistive element for monitoring a portion an input AC voltage; a first resistive element for superimposing the reference DC offset voltage on the monitored AC voltage to generate a control voltage having an AC component and a DC component; means for inverting the polarity of the variable DC offset voltage; a second resistive element for superimposing the inverted variable DC offset voltage on the control voltage to vary the control voltage in response to changes in the variable DC offset voltage; means for supplying the control voltage to an amplifier; and means for supplying an output voltage from the amplifier to energize the electrode of the corona charging device.

Pursuant to yet another aspect of the present invention, a system for maintaining substantially consistent current flow through a corona charging device including a corona generating electrode and a control surface driven by a DC voltage, comprising: a high voltage source for supplying a relatively high AC input voltage having a DC offset to the corona generating electrode; a DC voltage source for supplying a DC input voltage to the control surface; and an apparatus for maintaining a substantially constant voltage differential between the DC input voltage of the control surface and the DC offset of the AC input voltage of the corona generating electrode.

Other features of the present invention will become apparent as the following description proceeds and upon reference to the drawings, in which.

Figure 3:
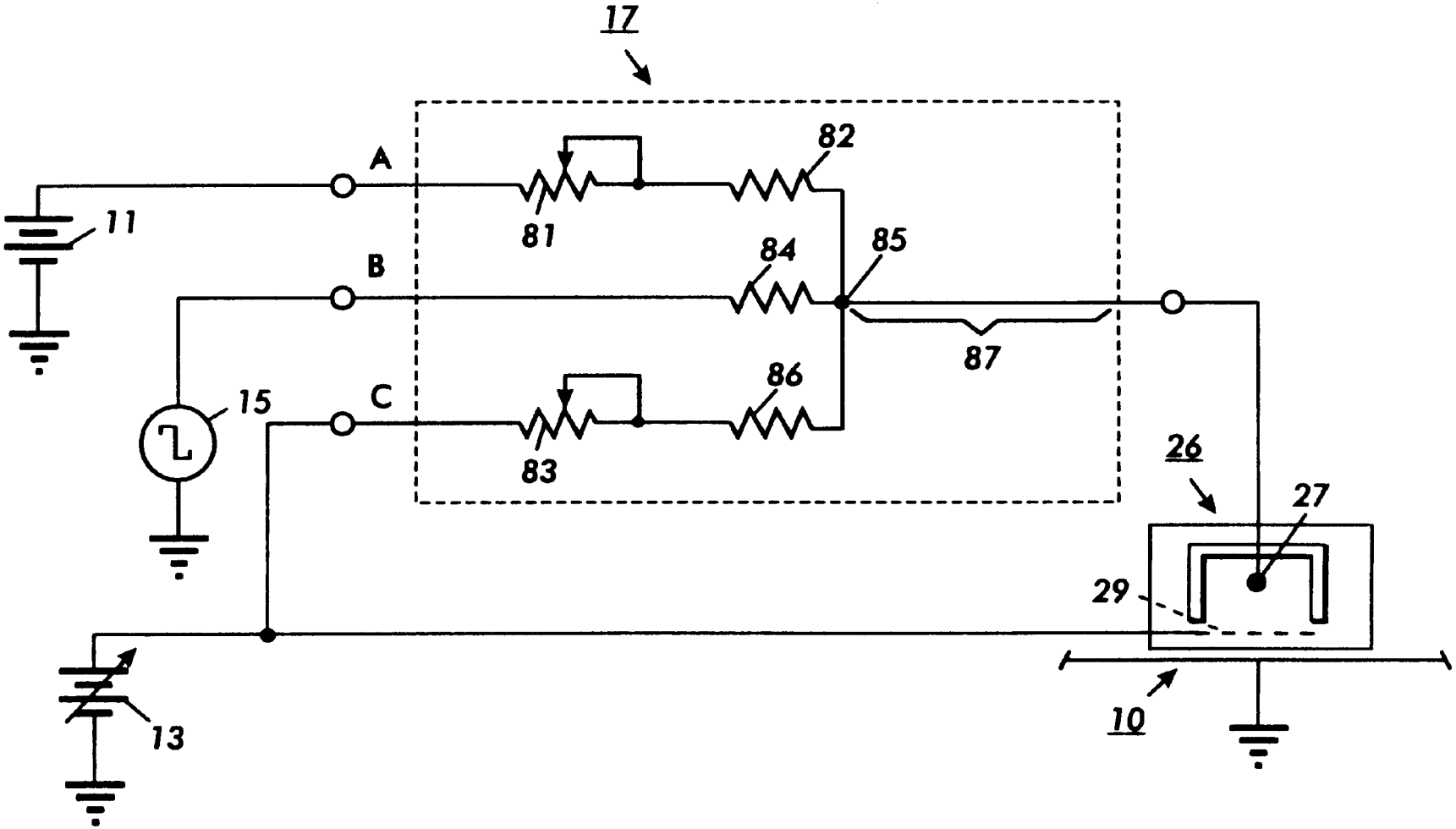
Figure 4:
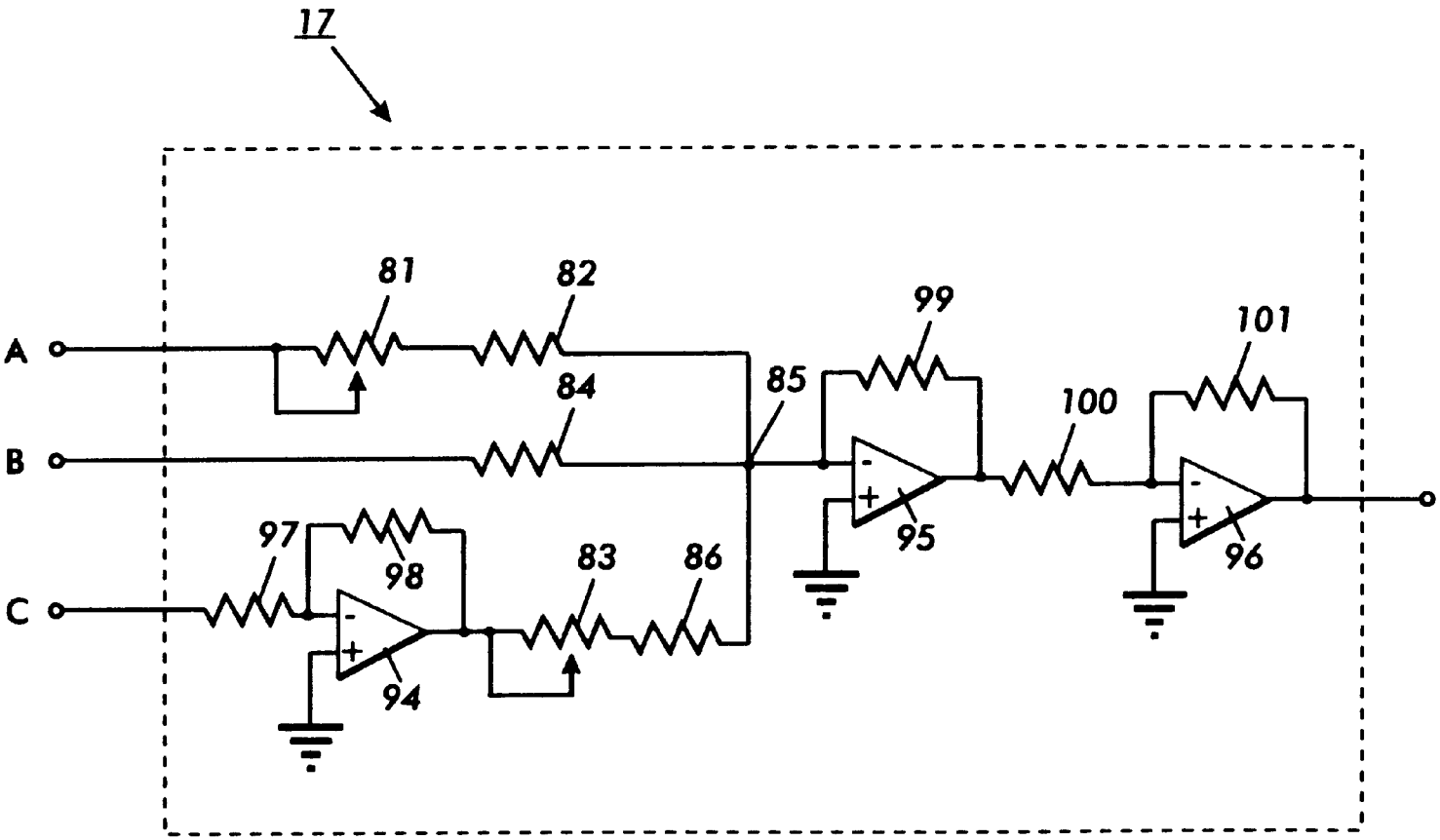

FIG. 3 schematically illustrates a passive embodiment of the present invention applied to a corona charging device having a coronode and a control surface; and FIG. 4 schematically illustrates an active embodiment of the present invention that may be applied to a scorotron.

While the present invention will be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

Figure 1:
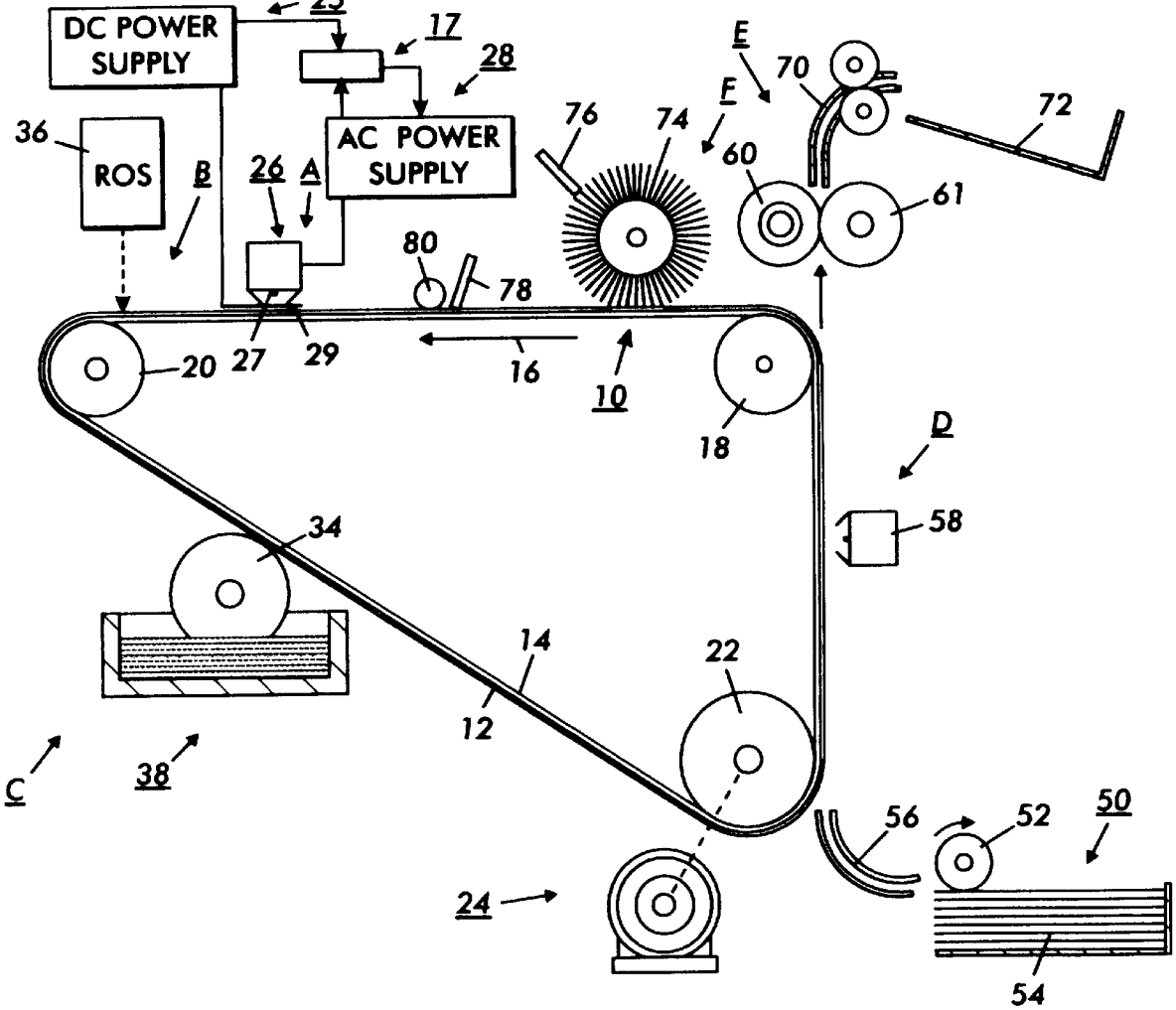
FIG. 1 is a schematic elevational view of a typical electrophotographic printing machine.

Inasmuch as the art of electrophotographic printing is well known, the various processing stations employed in the printing machine of FIG. 1 will be described briefly, prior to describing the invention in detail. As previously indicated, FIG. 1 is a schematic elevational view illustrating an exemplary electrophotographic printing machine incorporating the features of the present invention. In particular, the exemplary machine of FIG. 1 depicts a dry-toner developing material-based electrophotographic printing system. However, it will be understood that the apparatus of the present invention may be equally well-suited for use in a wide variety of printing machines and is not necessarily limited in its application to the particular electrophotographic machine described herein. For example, it will be explicitly understood that the method and apparatus of the present invention may find application in a liquid toner-type electrophotographic printing machine as well as the described dry-toner type printing machine. Moreover, the present invention need not be limited to electrophotographic printing technology as a whole and may find application in any field in which it is desirable to affix an image to a copy substrate. As such, it will be understood that, while the present invention will hereinafter be described in connection with a preferred system and embodiment, the description of the invention is not intended to be limited in its application to this described system or embodiment. On the contrary, the description is intended to cover all alternatives, modifications, and equivalents as may be included within the spirit and scope of the invention as defined by the appended claims.

Referring now to FIG. 1, the illustrative electrophotographic printing machine incorporates a photoreceptor 10 in the form of a belt having a photoconductive surface layer 12 on an electroconductive substrate 14. The belt is driven, via motor 24, along a curvilinear path defined by rollers 18, 20 and 22 in a counter-clockwise direction, as indicated by arrow 16.

Initially, a portion of the belt 10 passes through charging station A. An AC corona generator 26 in the form of a scorotron is provided thereat having an AC high voltage power supply 28 coupled to a corona generating electrode or so-called coronode 27, and a DC high voltage power supply 25 connected to a control surface or "grid" 29. The corona generator 26 charges surface 12 to a relatively high, substantially uniform potential. A critical parameter which arises in the use of AC corona generator 26 is the ability to maintain a consistent and predictable positive and negative corona current flow from corona generator 26 to photoreceptor 10. One method of achieving this is by a tracking circuit 17 of the present invention. The tracking circuit 17 insures that a constant voltage is maintained between the DC voltage level of grid 29 and a DC offset voltage on the AC wave which is driving coronode 27. The detailed structure of the tracking circuit 17 will be described in greater detail hereinafter with reference to FIGS. 2 through 4.

Next, the charged portion of photoconductive surface 12 is advanced through exposure station B. At exposure station B, ROS (Raster Output Scanner) 36 and a RIS (Raster Input Scanner), not shown, are used to expose the charged portions of photoconductive surface 12 for recording an electrostatic latent image thereon. The RIS contains document illumination lamps, optics, a mechanical scanning mechanism and photosensing elements such as charge-coupled device (CCD) arrays. The RIS captures the entire image from the original document and converts it to a series of raster scan lines. These raster scan lines are transmitted from the RIS to the ROS 36. ROS 36 illuminates the charged portion of photoconductive surface 12 with a series of horizontal lines, each line having a specific number of pixels per inch. These lines illuminate the charged portion of the photoconductive surface 12 to selectively discharge the charge thereon. An exemplary ROS 36 includes lasers, rotating polygon mirror blocks, solid state modulator bars and mirrors. It will be understood by those of skill in the art, that various image exposure systems are known in the art and may be adapted for use in the presently described printing system. For example, another type of exposure system may utilize a ROS 36 controlled by the output from an electronic subsystem (ESS) which prepares and manages the image data flow between a computer and the ROS 36. As such, the ESS (not shown) operates as the control electronics for the ROS 36, and may be embodied as a self-contained, dedicated microcomputer. In addition, one skilled in the art will appreciate that a light lens system may be used instead of the RIS/ROS system heretofore described, wherein an original document may be positioned face down upon a transparent platen, whereat light rays are reflected from the original document and transmitted through a lens forming a light image thereof. The lens focuses the light image onto the charged portion of photoconductive surface to selectively dissipate the charge thereon for recording an electrostatic latent image on the photoconductive surface corresponding to the informational areas contained within the original document disposed upon the transparent platen.

After the electrostatic latent image has been recorded on the photoconductive surface 12 of belt 10, belt 10 advances the latent image to a development station C. Development station C includes a developer unit, indicated generally by the reference numeral 38. Developer unit 38 includes a roller 34 adapted to advance dry-type developer material into contact with the electrostatic latent image recorded on the photoconductive surface. One skilled in the art will appreciate that a tray having an electrode adjacent the photoconductive belt may also be used to effect development of the latent image with liquid developer material therein. By way of example, the liquid developer material may comprise an insulating liquid carrier material made from an aliphatic hydrocarbon, largely decane, examples of which may include NOPAR™ or ISOPAR™, manufactured by the Exxon Corporation. Preferably, toner particles, made predominately from a pigmented material such as a suitable resin which may include carbon black, are dispersed in the liquid carrier. A suitable liquid developer material is described in U.S. Pat. No. 4,582,774, among numerous other patents which exist in the field of developing material technology.

Next, belt 10 advances the developed image to transfer station D. A copy sheet 54 is advanced from tray 50 by roll 52 and guides 56 into contact with the developed image on belt 10. A corona generator 58 sprays ions on the backside of the sheet 54 to attract the toner image from belt 10 to the sheet. As the belt turns around roller 18, the sheet is stripped therefrom with the toner image thereon.

Subsequently, the sheet is advanced by a conveyor (not shown) to fusing station E. Fusing station E includes a fusing system indicated generally by the reference 62. Preferably, fuser assembly 62 includes a heated fuser roller 60 and a pressure roller 61 with the powder image on the copy sheet contacting fuser roller 60. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll. After fusing, the sheet advances through chute 70 to catch tray 72 for subsequent removal from the printing machine by a machine operator.

After the sheet is separated from the photoconductive surface of belt 10, some residual liquid developer material typically remains adhering thereto. This residual developer material is removed from the photoconductive surface at cleaning station F. Cleaning station F includes a rotatably mounted fibrous brush 74 formed of any appropriate synthetic resin. Brush 74 may be driven opposite the direction of belt 10 to scrub the photoconductive surface clean. To assist in this action, developing liquid may be fed through pipe 76 onto the surface of brush 74. A doctor blade 78 completes the cleaning of the photoconductive surface. Any residual charge left on the photoconductive surface is extinguished by flooding the photoconductive surface with light from lamp 80.

The foregoing discussion provides a general description of the operation of an electrophotographic printing machine incorporating the present invention therein. The detailed structure of the constant DC offset coronode voltage tracking circuit will now be described with reference to FIGS. 2 through 4. It will be understood that the tracking circuit of the present invention may be utilized in a multicolor electrophotographic printing machine as well as in a monocolor printing machine.

Figure 2:
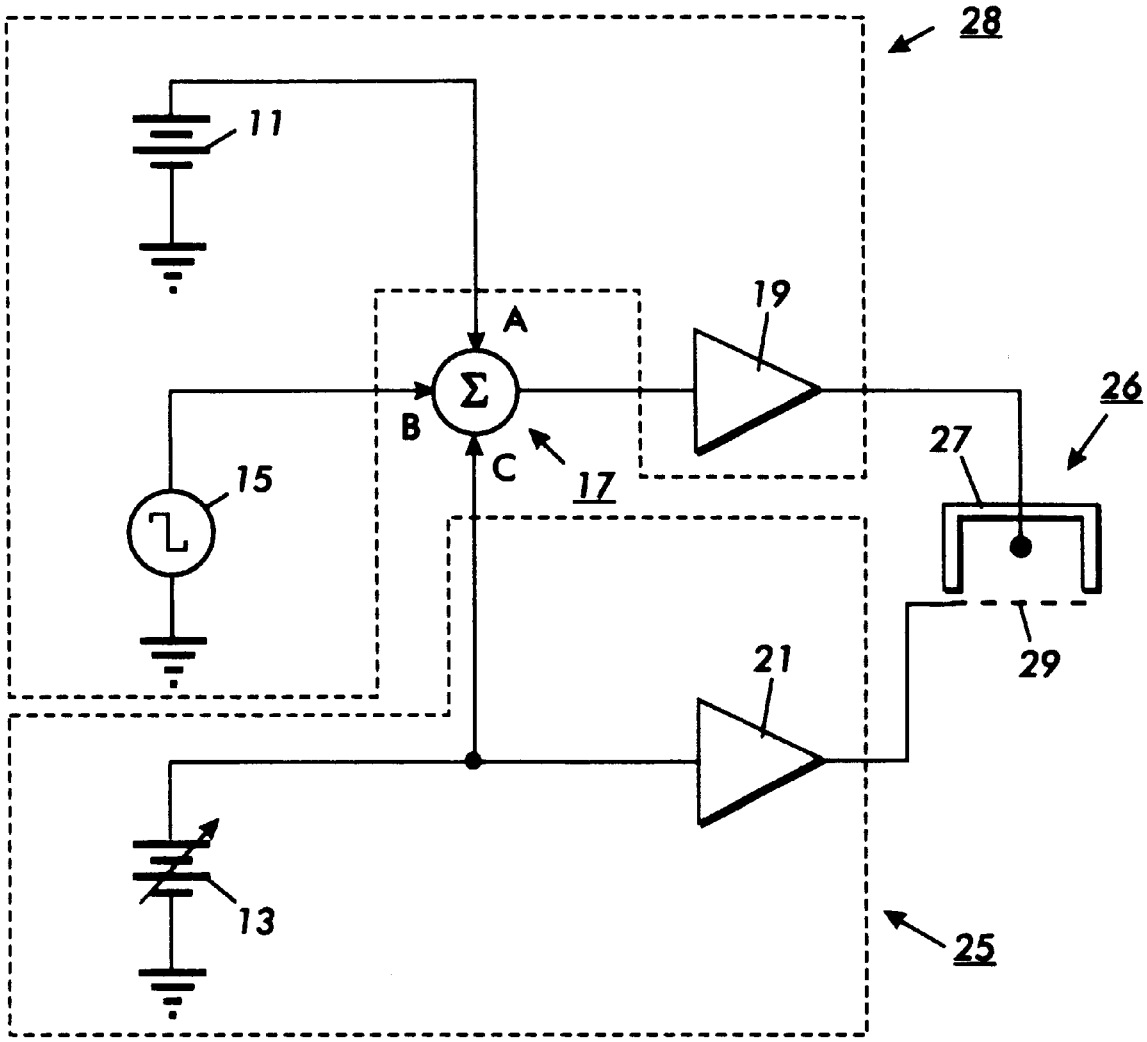
FIG. 2 is a schematic illustration of a scorotron charging system incorporating a constant DC offset coronode voltage tracking circuit according to the present invention.

Turning now to FIG. 2, there is shown a schematic illustration of a scorotron charging system 26 incorporating the constant DC offset coronode voltage tracking circuit 17 according to the present invention. The tracking circuit 17 is a summing configuration of three inputs A, B, and C to produce a control voltage output that is the input signal to a high voltage amplifier 19. The high voltage amplifier 19 is part of power supply 28 which provides high voltage AC to coronode 27 of scorotron 26. Inputs A and B are in power supply 28, while input C is in power supply 25. Input A is a coronode offset reference voltage 11. The coronode offset reference voltage provides a constant DC offset for being superimposed on the AC voltage source 15 of input B. Input C derives from an adjustable DC voltage source 13 that is amplified by a high voltage amplifier 21 to provide the actual voltage applied to grid 29. The non-amplified representation of voltage source 13 is also superimposed on the AC waveform of input B so that the output of tracking circuit 17 follows the voltage set point of grid 29. In this manner, changes which may be made to the offset voltage of coronode 27 are nearly identical to changes made to the scorotron's DC grid voltage in order to maintain a substantially consistent current to voltage behavior that compensates for photoreceptor aging or the requirements of charging different colored toners. By utilizing a representation of the grid voltage to adjust DC component of the coronode's AC voltage, positive and negative corona components can be brought into proper balance.

FIG. 3 schematically illustrates a passive embodiment of the tracking circuit 17 applied to corona charging device 26. In FIG. 3 a plurality of resistors comprising tracking circuit 17 algebraically sum inputs A, B, and C at point 85 to maintain the current to voltage relationship in the corona charging device 26. A resistor 84 monitors a portion of the voltage provided by AC voltage source 15, at input B. Potentiometer 81 calibrates the DC offset reference voltage 11 presented to input A. Resistor 82 next superimposes the calibrated DC offset voltage on the AC voltage monitored by resistor 84 to form a control voltage, at summing point 85, having an AC component and a DC component thereon. Next, potentiometer 81 calibrates the voltage, at input C, from the variable DC voltage source 13 supplying voltage to grid 29. A resistor 86 superimposes the calibrated voltage from voltage source 13 on the control voltage, at summing point 85, to vary the control voltage in response to changes in the variable voltage source 13. Finally, a conductor 87 conveys the control voltage to the electrode 27 of the corona charging device 26.

FIG. 4 schematically illustrates an active embodiment of the tracking circuit 17 applied to the scorotron 26 of FIG. 2. A first stage, comprised of an operational amplifier 94, and resistors 97 and 98, form a unity gain inverter stage for input C. This inverter stage has a high input impedance and serves to compensate for any output impedance limitations from a grid voltage amplifier not shown, but connected thereto. Since operational amplifier 94 is an inverter, it also changes the polarity of the grid voltage monitor signal. Potentiometer 83 is used to calibrate the gain of this particular leg of the summing amplifier. Resistor 84 is coupled to the AC source, at input B, and is flexible enough to provide a signal which can be applied to this unity gain leg of the summing amplifier with no further calibration necessary. Potentiometer 81 serves a similar calibration function for the constant offset portion of the summing amplifier, at input A. The amplifier section comprised of operational amplifier 95, resistor 99, resistor 82, resistor 84 and resistor 86 is the actual summing stage. One skilled in art will recognize that the output of amplifier 95 is the algebraic sum of the inputs. Furthermore, since amplifier 95 is a summing inverter, its output polarity is inverted. A final stage, comprising amplifier 96, resistor 100 and resistor 101 is a unity gain inverting amplifier that prepares this inverted polarity of the coronode control voltage signal for application to the coronode high voltage amplifier 19 shown in FIG. 2.

In review, the present invention comprises a constant DC offset coronode voltage tracking circuit that maintains a substantially consistent current to voltage relationship in a scorotron-type corona charging device, the electrode of which is driven by a DC offset AC voltage and the control surface of which is driven by a plurality of DC voltages over the operating range of the device. This is accomplished by utilizing an operational amplifier summing circuit to automatically maintain a constant potential difference between the DC voltage level of the control surface and the superimposed DC component of the AC waveform applied to the electrode of the corona generating device.

It is, therefore, apparent that there has been provided, in accordance with the present invention, a constant DC offset coronode voltage tracking circuit. This tracking circuit fully satisfies the aspects of the invention hereinbefore set forth. While this invention has been described in conjunction with specific embodiments thereof, it is evident that many alternatives, modifications and variations will be apparent to those skilled in the art. Accordingly, it is intended to embrace all such alternatives, modifications, and variations as fall within the spirit and broad scope of the appended claims.

What is claimed is:

1. A method for maintaining a substantially consistent current to voltage relationship in a corona charging device having an electrode energized by an AC voltage having a first DC voltage component and a second DC voltage component, and a control surface energized by a third DC voltage varied by the the second DC voltage component, comprising the steps of:

(a) monitoring a portion of the AC voltage;

(b) superimposing the first DC voltage on the voltage monitored by said step (a) to generate a control voltage having an AC component and the first DC voltage component;

(c) superimposing the second DC voltage component on the control voltage produced by said step (b) to vary the control voltage in response to changes in the second DC voltage component; and (d) supplying the control voltage produced in said step (c) to the electrode of the corona charging device.

2. The method as claimed in claim 1, further comprising the steps of:

(e) calibrating the first DC voltage component in said step (b) before superimposing the first DC voltage on the voltage monitored in step (a); and (f) calibrating the second DC voltage component in said step (c) before superimposing the second DC voltage component on the control voltage produced in said step (b).

3. An apparatus for maintaining a substantially consistent current to voltage relationship in a corona charging device having an electrode energized by an AC voltage having a first DC voltage component and a second DC voltage component, and a control surface energized by a third DC voltage varied by the second DC voltage component, comprising:

means for monitoring a portion of the AC voltage;

first means for superimposing the first DC voltage on the voltage monitored by said monitoring means to generate a control voltage having an AC component and the first DC voltage component;

second means for superimposing the second DC voltage component on the control voltage produced by said first superimposing means to vary the control voltage in response to changes in the second DC voltage component; and means for supplying the control voltage to the electrode of the corona charging device.

4. An apparatus according to claim 3, further comprising:

first means for calibrating the first DC voltage component; and second means for calibrating the second DC voltage component.

5. A summing circuit for maintaining a substantially consistent current to voltage relationship in a corona charging device having an electrode energized by an AC voltage having a first DC voltage and a second DC voltage, and a control surface energized by a third DC voltage varied by the second DC voltage, comprising:

a resistive element for monitoring a portion of the AC voltage;

a first resistive element for superimposing the first DC voltage on the monitored voltage to generate a control voltage having an AC component and a DC component;

a second resistive element for superimposing the second DC voltage on the control voltage to vary the control voltage in response to changes in the second DC voltage; and a conductor for supplying the control voltage to the electrode of the corona charging device.

6. The summing circuit according to claim 5, further comprising:

a first resistive element for calibrating the first DC voltage; and a second resistive element for calibrating the second DC voltage.

7. The summing circuit according to claim 6 wherein, said first resistive element is a potentiometer.

8. The summing circuit according to claim 6 wherein, said second resistive element is a potentiometer.

9. A summing amplifier for maintaining a substantially consistent current to voltage relationship in a corona charging device having an electrode energized by an AC voltage having a reference DC offset voltage and a variable DC offset voltage, and a control surface energized by a second reference DC voltage varied by the variable DC offset voltage, comprising:

a resistive element for monitoring a portion an input AC voltage;

a first resistive element for superimposing the reference DC offset voltage on the monitored AC voltage to generate a control voltage having an AC component and a DC component;

means for inverting the polarity of the variable DC offset voltage;

a second resistive element for superimposing the inverted variable DC offset voltage on the control voltage to vary the control voltage in response to changes in the variable DC offset voltage;

means for supplying the control voltage to an amplifier; and means for supplying an output voltage from the amplifier to energize the electrode of the corona charging device.

10. The summing amplifier according to claim 9, further comprising:

a first potentiometer for calibrating the reference DC offset voltage; and a second potentiometer for calibrating the variable DC offset voltage.

11. The summing amplifier according to claim 9 wherein, said inverting means comprises a first operational amplifier.

12. The summing amplifier according to claim 9 wherein, said supplying means comprises a second operational amplifier.

13. A system for maintaining substantially consistent current flow through a corona charging device including a corona generating electrode and a control surface driven by a DC voltage, comprising:

a high voltage source for supplying a relatively high AC input voltage having a DC offset to the corona generating electrode;

a DC voltage source for supplying a DC input voltage to the control surface; and an apparatus for maintaining a substantially constant voltage differential between the DC input voltage of the control surface and the DC offset of the AC input voltage of the corona generating electrode.

14. The system of claim 13, wherein said apparatus includes a summing circuit for producing a control voltage output for input to said high voltage source.

15. The system of claim 14, further including:

means for providing a first input to said summing circuit, said first input including an AC voltage;

means for providing a second input to said summing circuit, said second input including a DC offset reference signal; and means for providing a third input to said summing circuit, said third input including an attenuated representation of the DC input voltage to the control surface;

wherein, said summing circuit is operative to superimpose said second and third inputs on the AC voltage so that the DC offset of the relatively high AC input voltage to the corona generating electrode tracks the DC input voltage to the control surface.

16. The system of claim 14, wherein the summing circuit includes:

a high input impedance unity gain inverter for providing the attenuated representation of the DC input voltage to the control surface to compensate for output impedance limitations and polarity thereof;

a summing stage including an amplifier section; and an inverting amplifier for providing the control voltage to the electrode to compensate for polarity thereof.

* * * * *